US009534189B2

(12) United States Patent
Tran et al.

(10) Patent No.: US 9,534,189 B2
(45) Date of Patent: Jan. 3, 2017

(54) HYDRAULIC FLUIDS AND FIRE-RESISTANT FLUIDS COMPRISING GLYCERIN CONTAINING BY-PRODUCTS

(75) Inventors: Bo L. Tran, Chicago, IL (US); Joseph M. Hamnik, Lisle, IL (US); Stephen J. Blubaugh, Naperville, IL (US)

(73) Assignee: Nalco Company, St. Paul, MN (US)

( * ) Notice: Subject to any disclaimer, the term of this patent is extended or adjusted under 35 U.S.C. 154(b) by 1277 days.

(21) Appl. No.: 11/524,815

(22) Filed: Sep. 21, 2006

(65) Prior Publication Data

US 2008/0085846 A1 Apr. 10, 2008

Related U.S. Application Data

(63) Continuation-in-part of application No. 11/420,140, filed on May 24, 2006, now abandoned.

(51) Int. Cl.
*C10M 105/14* (2006.01)
*C10M 173/02* (2006.01)

(52) U.S. Cl.
CPC ..... *C10M 173/02* (2013.01); *C10M 105/14* (2013.01); *C10M 2201/02* (2013.01); *C10M 2207/021* (2013.01); *C10M 2207/022* (2013.01); *C10M 2207/0215* (2013.01); *C10M 2207/0225* (2013.01); *C10M 2207/281* (2013.01); *C10M 2207/2815* (2013.01); *C10N 2230/06* (2013.01); *C10N 2240/08* (2013.01)

(58) Field of Classification Search
CPC ..... C10M 105/14
USPC ..... 508/577, 583
See application file for complete search history.

(56) References Cited

U.S. PATENT DOCUMENTS

| | | | | |
|---|---|---|---|---|
| 5,250,205 | A * | 10/1993 | Akimoto et al. | 508/466 |
| 6,518,225 | B1 * | 2/2003 | Fukutani et al. | 508/180 |
| 6,585,933 | B1 * | 7/2003 | Ehrhardt et al. | 422/16 |
| 2004/0116304 | A1 * | 6/2004 | Wu et al. | 507/100 |
| 2005/0160795 | A1 * | 7/2005 | Hoots et al. | 73/40.7 |
| 2005/0247907 | A1 * | 11/2005 | Sapienza et al. | 252/70 |
| 2006/0093660 | A1 * | 5/2006 | Bolotin | 424/450 |

OTHER PUBLICATIONS

International Search Report for PCT/US07/69444.
Written Opinion PCT/US07/69444.

* cited by examiner

*Primary Examiner* — Taiwo Oladapo
(74) *Attorney, Agent, or Firm* — Kagan Binder, PLLC

(57) ABSTRACT

Hydraulic fluid and fire-resistant fluid compositions and methods of using the compositions are provided. In an embodiment, the present invention provides a method of utilizing fire-resistant fluid in hydraulic systems. For example, the method can comprise utilizing fire-resistant fluid in hydraulic systems of casters found in steel mills, in an environment where fire safety is of concern. The fire-resistant composition can comprise one or more glycerin by-products derived from a biodiesel manufacturing process. The fire-resistant composition can also comprise one or more glycerin by-products of transesterification reactions involving triglycerides. The fire-resistant fluid can be added to hydraulic systems as a solution.

14 Claims, No Drawings

HYDRAULIC FLUIDS AND FIRE-RESISTANT FLUIDS COMPRISING GLYCERIN CONTAINING BY-PRODUCTS

CROSS REFERENCE TO RELATED APPLICATIONS

This is a continuation in part of Ser. No. 11/420,140, filed May 24, 2006 now abandoned.

TECHNICAL FIELD

This invention relates to hydraulic fluids and fire-resistant fluids. More particularly, this invention concerns hydraulic fluids and fire-resistant fluids comprising glycerin-containing by-products from a biodiesel manufacturing process or transesterification reactions involving triglycerides and method of using the fluids.

BACKGROUND OF THE INVENTION

Hydraulic power transmission uses a liquid medium to transmit energy to control force and movement in innumerable industrial and mobile systems. Hydraulic fluid refers to liquids used for this purpose.

Hydraulic fluids may be water-based and non-water based. Water-based hydraulic fluids include water/glycol hydraulic fluids used for high pressure applications (below about 3,000 psig), water-in-oil emulsion hydraulic fluids used for medium-pressure applications (below about 800 psig) and oil-in-water emulsion hydraulic fluids typically used for low pressure applications (below about 300 psig). Non water-based hydraulic fluids generally include phosphate ester based hydraulic fluids, polyol ester hydraulic fluids, mineral oils, or synthetic oil blends.

Fire-resistant fluids commonly include oil-in-water emulsions classified as ISO-type HFAE, water-in-oil emulsions, ISO-type HFB, water-glycol solutions, ISO-type HFC, phosphate esters, ISO-type HFDR and organic esters, ISO-type HFDU. Water glycol fluids have proven to be excellent fire-resistant fluid options. It is desirable to provide and utilize cost-effective hydraulic fluids and fire-resistant fluids that are green and derived from renewable sources.

SUMMARY OF THE INVENTION

This invention is a hydraulic fluid or fire-resistant fluid comprising a glycerin-containing by-product from a biodiesel manufacturing process or transesterification reactions involving triglycerides wherein the hydraulic fluid comprises about 40 to about 99 weight percent of glycerin.

This invention provides cost-effective hydraulic and fire-resistant fluids which are green and derived from renewable sources. The glycerin by-products are also non-combustible and can provide benefits in applications where there is a "high" flash point requirement.

DETAILED DESCRIPTION OF THE INVENTION

As used herein, "fire-resistant fluid" means compositions that are non-combustible. Suitable processes that utilize fire-resistant fluids include, but not limited to, hydraulic systems.

"By-products" means by-products derived from biodiesel manufacturing processes and transesterification reactions involving triglycerides. "Green" means non-hazardous, non-toxic, biodegradable, environmentally friendly, and/or derived from renewable sources.

In an embodiment, the by-product comprises about 40 to about 90 weight percent of glycerin.

In an embodiment, the by-product is derived from transesterification reactions involving triglycerides. For example, long chain alcohols used in the detergent industry can be derived from transesterification of triglycerides. In this process crude glycerin can be generated as a by-product. Vegetable oil and tallow fat are the major feedstock for this route to alcohols. The triglycerides are first subjected to transesterification from which methyl esters and crude glycerin are formed. The resulting methyl esters are then hydrogenised to form the long chain alcohols, which can be used in the detergent industry.

In an embodiment, the by-product is derived from a biodiesel manufacturing process.

Biodiesel is a cleaner-burning diesel replacement fuel made from natural, renewable sources. For example, biodiesel can include fatty acid alkyl esters used as a cleaner-burning diesel replacement fuel made from sources such as new and used vegetable oils and animal fats.

According to the American Fuel Data Center of the U.S. Department of Energy, approximately 55% of the biodiesel is currently produced from recycled fat or oil feedstock, including recycled cooking grease. The other half of the industry is limited to vegetable oils, the least expensive of which is soy oil. The soy industry has been the driving force behind biodiesel commercialization because of excess production capacity, product surpluses, and declining prices. Similar issues apply to the recycled grease and animal fats industry, even though these feedstocks are less expensive than soy oils. Based on the combined resources of both industries, there is enough of the feedstock to supply 1.9 billion gallons of biodiesel.

Biodiesel is typically made through a chemical process called transesterification in which vegetable oil or animal fats are converted to fatty acid alkyl esters and glycerin by-products. Such oils and fats include, for example, tallow, crude tall oil, coconut oil, rapeseed oil, canola oil, palm kernel oil and soybean oil. Triglycerides, the principal components of animal fats and of vegetable oils, are esters of glycerol, a trihydric alcohol, with fatty acids of varying molecular weight. Fatty acids and fatty acid alkyl esters can be produced from oils and fats by base-catalyzed transesterification of the oil, direct acid-catalyzed esterification of the oil and conversion of the oil to fatty acids and subsequent esterification to biodiesel.

The majority of fatty acid alkyl esters are produced by the base-catalyzed method. In general, any base may be used as the catalyst used for transesterification of the oil to produce biodiesel, however sodium hydroxide or potassium hydroxide are used in most commercial processes.

In the biodiesel manufacturing process, the oils and fats can be filtered and preprocessed to remove water and contaminants. If free fatty acids are present, they can be removed or transformed into biodiesel using special pretreatment technologies, such as acid catalyzed esterification. The pretreated oils and fats can then be mixed with an alcohol and a catalyst (e.g. base). The base used for the reaction is typically sodium hydroxide or potassium hydroxide, being dissolved in the alcohol used (typically ethanol or methanol) to form the corresponding alkoxide, with standard agitation or mixing. It should be appreciated that any suitable base can be used. The alkoxide may then be charged into a closed reaction vessel and the oils and fats are added. The system can then be closed, and held at about 71° C.

(160° F.) for a period of about 1 to 8 hours, although some systems recommend that the reactions take place at room temperature.

Once the reactions are complete the oil molecules (e.g. triglycerides) are hydrolyzed and two major products are produced: 1) a crude fatty acid alkyl esters phase (i.e. biodiesel phase) and 2) a glycerin by-product phase. Typically, the crude fatty acid alkyl esters phase forms a layer on top of the denser glycerin by-product phase. Because the glycerin by-product phase is denser than the biodiesel phase, the two can be gravity separated. For example, the glycerin by-product phase can be simply drawn off the bottom of a settling vessel. In some cases, a centrifuge may be employed to speed the separation of the two phases.

The glycerin by-product phase typically consists of a mixture of glycerin, methyl esters, methanol, mong and inorganic salts and water. Mong is "matiere organique non glycerol". Mong normally consists of soaps, free fatty acids, and other impurities.

Methyl esters and methanol are typically present in an amount of about 0.01 to about 5 percent.

Typical inorganic salts include, for example, salts (e.g. chlorides and sulfates) of sodium, potassium and/or calcium. In an embodiment, the by-products can contain about 0.01 to about 15 weight percent of the inorganic salts. In an embodiment, the inorganic salts are selected from sodium and potassium chloride.

Hydraulic fluids and fire-resistant fluids are readily prepared from the glycerin by-products by adding any desired functional additives and optionally diluting to the desired glycerin concentration with any suitable diluent, preferably water. Water can be de-ionized or distilled.

In certain instances, it may be necessary to further refine the glycerin by-product prior to use, for example by washing, acidulation or distillation to adjust the glycerin concentration and/or remove impurities. The hydraulic fluids and fire-resistant fluids are added to the hydraulic system as liquids.

In an embodiment, the hydraulic fluid or fire-resistant fluid comprises about 40 to about 70 weight percent glycerin.

Typical additives are known in the art and may include corrosion inhibitors, surfactants, pH conditioners, antioxidants, sequestering agents, emulsifiers, de-emulsifiers, oils, anti-foam agents, bactericides, lubricants, thickeners, dyes, and the like.

Many industrial applications such as steel making, die casting, and rolling mills require the use of fire-resistant fluids that offer greater fire safety than that achievable with mineral oils. Vegetable oils have been used but the high cost of these fluids limits their use.

One of the most common alternatives to mineral oils and vegetable oils for use in these applications is a water-glycol fluid. The glycols in the fluid are typically diethylene glycol, ethylene glycol and/or propylene glycol. Fire-resistant fluids according to this invention can be used to supplement or replace conventional glycol mixtures especially glycol mixtures that include ethylene glycol, a toxic material.

Accordingly, in an embodiment, the hydraulic fluid or fire-resistant fluid of this invention further comprises one or more glycols.

The fire-resistant fluids of this invention offer the additional benefit of not posing any environmental and/or human health hazard if accidentally released into the environment or contacted by humans or animals.

In an embodiment, the present invention provides methods of utilizing fire-resistant fluid. For example, fire-resistant compositions comprising the glycerin by-products can be useful in hydraulic systems including, but not limited to, hydraulic systems of the caster system of steel mills. The fire-resistant compositions can also be used in conjunction with other suitable fire-resistant fluids and/or additives that enhance the fluid properties.

As discussed above, hydraulic fluids are used in many different types of production plants to operate the equipment used in the plants' operations. Hydraulic fluid may leak from the hydraulic systems of the equipment onto surrounding equipment, building structures, and, in certain production processes, into the cooling water used to cool the product that is being produced. Industries where cooling water may be contacted by leaked hydraulic fluid include steel mills, aluminum mills, rolling mills, certain plastic manufacturing facilities and plants where copper, zinc, nickel and alloys thereof are processed.

Minimizing hydraulic fluid leaks into cooling water in these systems offers a variety of potential benefits including a reduced risk of microbiological growth caused by microorganisms which feed and grow by digesting hydraulic fluid and corresponding reduced use of oxidizing biocides, reduced variability of the process cooling water chemistry and reduced risk of process failures.

Methods of using fluorescent tracers in hydraulic fluids to detect and compensate for leakage of the fluid in production plants are described in U.S. Pat. No. 6,966,213, incorporated by reference.

Accordingly, in an embodiment, one or more inert fluorescent tracers are added to the hydraulic fluid of this invention. Representative inert fluorescent tracers are described in U.S. Pat. No. 6,966,213. The tracers are typically incorporated into the hydraulic fluid in amount ranging from about 0.01 ppm to about 10,000 ppm, preferably from about 0.05 ppm to about 10 ppm and more preferably from about 0.1 ppm to about 1.0 ppm.

In an embodiment, the tracers are selected from fluorescein, fluorescein sodium salt, 2-antracenesulfonic acid sodium salt, 1,5-anthracenedisulfonic acid, 2,6-anthracenedisulfonic acid, 1,8-anthracenedisulfonic acid and 1,5-anthracenedisulfonic acid, disodium salt.

At least one embodiment of the invention is a method of operating equipment in which a fluid is used to transmit energy to control force and movement in the equipment, comprising the step of introducing into a hydraulic system a fluid comprising a glycerin-containing by-product from a biodiesel manufacturing process or transesterification reactions involving triglycerides wherein the majority of the fluid used to transmit the energy is the by-product and the fluid used to transmit the energy has a wear characteristic of less than 1 mm scar diameter maximum wherein the fluid comprises 90 to 99 percent glycerin, the by-product further comprises 0.01 to less than 2% inorganic salts, 0.01 to less than 0.5% methanol, and mong.

At least one embodiment of the invention is a method of operating equipment in which a fluid is used to transmit energy to control force and movement in the equipment, comprising the step of introducing into a hydraulic system a fluid comprising a glycerin-containing by-product from a biodiesel manufacturing process or transesterification reactions involving triglycerides wherein the majority of the fluid used to transmit the energy is the by-product and the fluid used to transmit the energy has a wear characteristic of less than 1 mm scar diameter maximum wherein the fluid comprises 90 to 99 percent glycerin, the by-product further comprises 0.01 to less than 0.5% methanol, and mong.

EXAMPLE

A hydraulic fluid comprising a glycerin containing by-product from a biodiesel manufacturing process is tested for wear characteristic, utilizing ASTM D4172 test—"Four Ball Wear." The by-product contains about 90% glycerin by weight.

The wear data show 0.79 millimeter scar diameter. American Iron and Steel Engineers' acceptable value is 1 millimeter scar diameter maximum. Hence, the glycerin by-product wear characteristic would be acceptable by industry standard.

While the present invention is described above in connection with representative or illustrative embodiments, these embodiments are not intended to be exhaustive or limiting of the invention. Rather, the invention is intended to cover all alternatives, modifications and equivalents included within its spirit and scope, as defined by the appended claims.

The invention is claimed as follows:

1. A method of operating equipment in which a fluid is used to transmit energy to control force and movement in the equipment, comprising the step of introducing into a hydraulic system a fluid comprising a glycerin-containing by-product from a biodiesel manufacturing process or transesterification reactions involving triglycerides wherein the majority of the fluid used to transmit the energy is the by-product and the fluid used to transmit the energy has a wear characteristic of less than 1 mm scar diameter maximum wherein the fluid comprises 90 to 99 percent glycerin, the by-product further comprises 0.01 to less than 2% inorganic salts, 0.01 to less than 0.5% methanol, and mong.

2. The method of claim 1 wherein the glycerin-containing by-product is derived from a biodiesel manufacturing process.

3. The method of claim 1 wherein the glycerin-containing by-product is derived from transesterification reactions involving triglycerides.

4. The method of claim 2 wherein the glycerin-containing by-product further comprises methyl esters and the methyl esters are 0.01 to less than 5% of the by-product.

5. The method of claim 1 wherein the fluid further comprises one or more corrosion inhibitors, surfactants, pH conditioners, antioxidants, sequestering agents, emulsifiers, de-emulsifiers, oils, anti-foam agents, bactericides, lubricants, thickeners or dyes.

6. The method of claim 1 wherein the fluid further comprises one or more glycols.

7. The method of claim 1 wherein the fluid further comprises one or more inert fluorescent tracers.

8. The method of claim 1 wherein the fluid is selected from the group consisting of hydraulic fluids and fire-resistant fluids.

9. The method of claim 1 wherein the equipment is the hydraulic systems of the caster system of steel mills.

10. The method of claim 1 wherein the fluid essentially excludes glycol.

11. The method of claim 1 in which the fluid comprises more than 50 to 70 weight percent by-product.

12. A method of operating equipment in which a fluid is used to transmit energy to control force and movement in the equipment, comprising the step of introducing into a hydraulic system a fluid comprising a glycerin-containing by-product from a biodiesel manufacturing process or transesterification reactions involving triglycerides wherein the majority of the fluid used to transmit the energy is the by-product and the fluid used to transmit the energy has a wear characteristic of less than 1 mm scar diameter maximum wherein the fluid comprises 90 to 99 percent glycerin, the by-product further comprises 0.01 to less than 0.5% methanol, and mong.

13. A method of operating equipment in which a fluid is used to transmit energy to control force and movement in the equipment, comprising the step of introducing into a hydraulic system a fluid comprising a glycerin-containing by-product from a biodiesel manufacturing process or transesterification reactions involving triglycerides wherein the majority of the fluid used to transmit the energy is the by-product and the fluid used to transmit the energy has a wear characteristic of less than 1 mm scar diameter maximum wherein the fluid comprises 90 to 95 percent glycerin, the by-product further comprises methyl esters, and mong.

14. The method of claim 13 wherein the glycerin-containing by-product comprises methyl esters and the methyl esters are 0.01 to 5% weight percent of the by-product.

* * * * *